United States Patent [19]

Riley

[11] 4,406,574

[45] Sep. 27, 1983

[54] VEHICLE ASSIST FOR DISABLED

[76] Inventor: Sidney L. Riley, 2043 Cummings, Berkley, Mich. 48072

[21] Appl. No.: 212,116

[22] Filed: Dec. 2, 1980

Related U.S. Application Data

[63] Continuation of Ser. No. 928,904, Jul. 28, 1978, abandoned.

[51] Int. Cl.[3] ..... B66C 1/68; B66C 23/06

[52] U.S. Cl. ..... 414/543; 212/188; 212/180

[58] Field of Search ..... 414/546, 548, 550, 555, 414/558, 569, 540, 541, 542, 543, 921, 462; 212/180, 182, 183, 185, 187, 232, 237, 238, 244, 188

[56] References Cited

U.S. PATENT DOCUMENTS

| | | | |
|---|---|---|---|
| 2,559,733 | 7/1951 | Pitman et al. | 212/67 |
| 2,846,091 | 8/1958 | Heffner | 414/550 |
| 3,362,550 | 1/1968 | Kappler | 254/139.1 X |
| 3,796,331 | 3/1974 | Dutton | 414/550 X |
| 3,804,263 | 4/1974 | Castonquay | 414/543 X |
| 3,854,594 | 12/1974 | Brooks | 414/543 X |
| 3,990,737 | 11/1976 | Palmer | 296/35.1 |
| 4,019,642 | 4/1977 | Hammar | 414/546 |
| 4,127,200 | 11/1978 | Mann | 414/543 |
| 4,133,437 | 1/1979 | Gates | 414/921 X |

FOREIGN PATENT DOCUMENTS

| | | | |
|---|---|---|---|
| 1233552 | 2/1967 | Fed. Rep. of Germany | 212/8 R |

*Primary Examiner*—Bruce H. Stoner, Jr.
*Assistant Examiner*—James Barlow
*Attorney, Agent, or Firm*—Harness, Dickey & Pierce

[57] ABSTRACT

A device for lifting and loading objects into and from a storage space of an automobile for transportation thereby. The device is fully contained within the storage space and is adapted to be mounted directly to the chassis of the automobile. The device is particularly suited to assist disabled individuals who may be unable to lift, load and transport such objects otherwise.

1 Claim, 2 Drawing Figures

VEHICLE ASSIST FOR DISABLED

This is a continuation, of application Ser. No. 928,904, filed July 28, 1978, now abandoned.

BACKGROUND OF THE INVENTION

This invention relates to a lifting device, and more particularly, to an improved device for lifting and loading objects into and from a storage space of an automobile.

Many disabled or handicapped individuals are unable to lift heavy or cumbersome objects due to their particular afflictions. Such individuals likewise have difficulty in loading and unloading objects generally from an automobile due to the spacial orientation of automobile storage spaces, such as trunk spaces, which require bending, twisting or other body movements which may be painful or otherwise impossible due to physical limitations. It is desirable therefore to provide means for assisting such individuals in lifting, loading and unloading such objects.

It is, therefore, a principle object of this invention to provide an improved and compact device to assist in the lifting of objects and the loading of same to and from a storage space of an automobile.

It is another object of this invention to provide for such a device which can be fully contained within such a storage space such that the device may be transported by the automobile from place to place and utilized.

It is yet another object of this invention to provide for such a device which may be permanently mounted within the storage space for support directly by the chassis of an automobile.

SUMMARY OF THE INVENTION

This invention relates to an improved and compact device adapted to assist an individual in lifting and loading objects between a storage space of an automobile and a point outside the automobile. The device comprises an object engaging member adapted to secure the object, a support and moving mechanism possessing three directional movement capability which supports the object engaging member and allows the device to lift and load the object into and from the storage space. The device is relatively compact and operates in such a way so that it can be fully retained within the storage space when not in use and transported from one location to another. Power means are incorporated for actuating the support and moving mechanism.

The device includes means for mounting the device within the storage space which enables the device to be mounted to and supported directly by the chassis of the automobile. Such a mounting means is adapted to pass through a portion of the sheet metal of the body of the automobile and provide intimate contact with the chassis thereof.

When so utilized with the storage space of an automobile, the device creates a novel and useful combination of a storage space with means for loading objects thereinto adapted to facilitate the moving of objects from one place to another by a disabled individual with the automobile.

DETAILED DESCRIPTION OF THE PREFERRED EMBODIMENT

Figure 1:
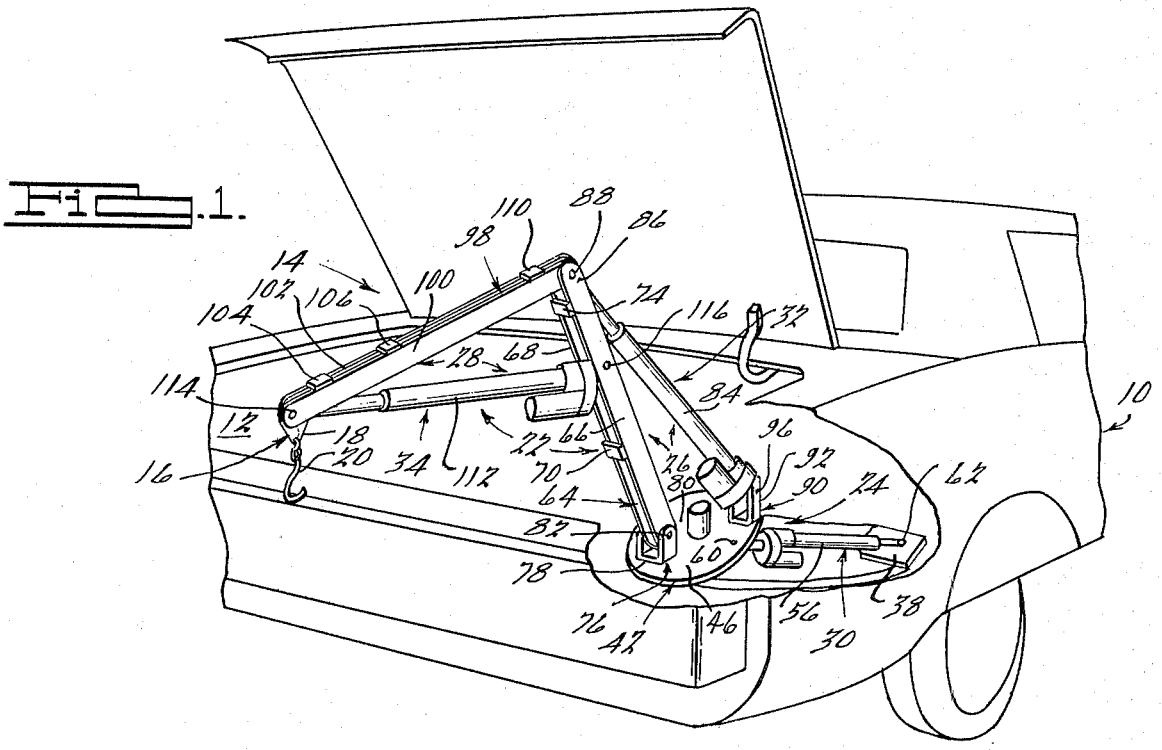
FIG. 1 is a perspective view, with a portion broken away, at the rear end of an automobile embodying this invention.

Referring first to FIG. 1, there is shown generally an automobile 10 containing therewithin a storage space 12 which in this instance is the trunk space of the automobile 10. A lifting and loading device constructed in accordance with the present invention is shown generally at 14. The device 14 can be seen as being contained and mounted in the storage space 12. The mounting of the device 14 within the storage space 12 will be described more fully hereinafter.

The device 14 includes an object engaging member 16 which may be comprised of a relatively thin metal plate 18 with a chain and hook combination 20 attached thereto. Connected to and supporting the object engaging member 16 is a supporting means 22 which is adapted to be mounted within the storage space 12. The supporting means 22 possesses rotational means 24, vertical moving means 26 and horizontal moving means 28. Rotational means 24 includes a driving means 30 adapted to rotate the supporting means 22 and the object engaging member 16 relative to a point of reference within the storage space 12. Vertical moving means 26 includdes a second driving means 32 adapted to move the supporting means 22 and the object engaging member 16 primarily in a verticle direction relative to said point of reference. Likewise, horizontal moving means 28 includes a third driving means 34 adapted to move the supporting means 22 and the object engaging member 16 horizontally relative to said point of reference. A power means (not shown) is included to actuate each of said driving means. The power means may be adapted to run off the battery of the automobile 10 and may possess controls to independently actuate each driving means. The combination of the rotational means 24, the vertical moving means 26 and the horizontal moving means 28 allows the supporting means 22 to move the object engaging member 16 in three directions so as to facilitate the lifting and loading of objects to and from the storage spaces 12.

In the preferred embodiment, rotational means 24 comprises a relatively thin elongated metal plate assembly 38 which has an elongated cylindrical shaft 40 extending in a substantially perpendicular direction from one face of the plate assembly 38. The rotational means 24 further comprises a turntable portion 42 adapted to rotate about the shaft 40. The turntable portion 42 is comprised of an elongated hollow cylindrical portion 44 having a relatively thin turntable plate 46 extending radially from the outer surface 48 of the cylindrical portion 44 and perpendicularly of the longitudinal axis of cylindrical portion 44. Journal bearings 50 and 52 are provided to allow the turntable portion 42 to freely rotate about shaft 40. The internal diameter of cylindrical portion 44 is such as to allow the turntable portion 42 to fit over shaft 40 and receive the journal bearings 50 and 52. The turntable portion 42 is secured on plate assembly 38 and shaft 40 by way of snap ring 54 which fits over shaft 40 and snaps into a suitable groove in the shaft 40.

Driving means 30 is comprised of an axially extending screw jack drive or lineator 56, which may be of the recirculating ball nut ype. Lineator 56 is pivotably connected at one end thereof to the bottom face 58 of turntable plate 46 of turntable portion 42 at point 60, which is radially offset from cylindrical portion 44. The other end of lineator 56 is pivotably connected to plate assembly 38 at 62. Such a configuration allows lineator 56 to exert a force upon turntable portion 42 which tends to rotate the turntable portion 42 about shaft 40 when lineator 56 is actuated by the power means (not shown).

Vertical moving means 26 is comprised of an elongated supporting member 64 which may be formed by two relatively thin parallel elongated plate members 66 and 68 secured to and spaced from one another by spacers 70, 72 and 74. Supporting member 64 is supported by and is pivotably connected at one end thereof to turntable portion 42 by way of pivot member 76. Pivot member 76 is comprised of a U-shaped bracket 78 which is welded or otherwise secured to the top face 80 of turntable plate 46 of turntable portion 42 at a point radially offset from shaft 40. Supporting member 64 is designed to fit within bracket 78 and be pivotably retained therein by pivot pin 82 which passes through bracket 78 and plate members 66 and 68. The second driving means 32 associated with vertical moving means 26 is an axially extending screw jack drive or lineator 84 which may be of the recirculating ball nut type. Lineator 84 is pivotably connected at one end thereof to supporting member 64 at the end 86 opposite the end at which the supporting member 64 is connected to turntable portion 42. Lineator 84 is designed to fit within end 86 between plate members 66 and 68. The pivotal connection is accomplished by pivot pin 88 which passes through lineator 84 and plate members 66 and 68. Lineator 84 is likewise pivotably connected at its opposite end to turntable portion 42 by way of pivot member 90. Pivot member 90 is comprised of a U-shaped bracket 92 which is welded or otherwise secured to the top face 80 of turntable plate 46 of turntable portion 42 at a point radially offset from shaft 40 on the side of plate 46 opposite bracket 78 along the diameter of turntable plate 46 running through bracket 78 and shaft 40. Lineator 84 is designed to fit within bracket 92 and be pivotably retained by pivot pin 96 which passes through bracket 92 and lineator 84. This configuration enables lineator 84 to exert a force on supporting member 64 when lineator 84 is actuated by the power means (not shown) such that supporting member 64 may pivot relative to turntable portion 42.

Horizontal moving means 28 comprises an elongated lifting member 98 which may be comprised of two relatively thin parallel elongated plate members 100 and 102 secured to and spaced from one another by spacers 104, 106, 108 and 110. One end of lifting member 98 is designed to fit between plate members 66 and 68 of supporting member 64 at end 86 thereof and be pivotably retained by pivot pin 88. In this manner, lifting member 98 may be pivotably connected to supporting member 64. The third driving means 34 associated with horizontal moving means 28 is comprised of an axially extending screw jack drive or lineator 112 which may be of the recirculating ball nut type. One end of lineator 112 is designed to fit between plate members 100 and 102 of lifting member 98 at the end thereof opposite the end at which lifting member 98 is pivotably connected to supporting member 64 and be pivotably retained by pivot pin 114 which passes through plate members 100 and 102 and lineator 112. In this manner, lineator 112 is pivotably connected to lifting member 98. The other end of lineator 112 is designed to fit between plate members 66 and 68 of supporting member 64 at a point between the ends of supporting member 64 and be pivotably retained by pivot pin 116 which passes through plate members 66 and 68 and lineator 112. In this manner, lineator 112 is pivotably connected to supporting member 64. This configuration enables lineator 112 to exert a force on lifting member 98 when lineator 112 is actuated by the power means (not shown) such that lifting member 98 may pivot relative to supporting member 64.

Figure 2:
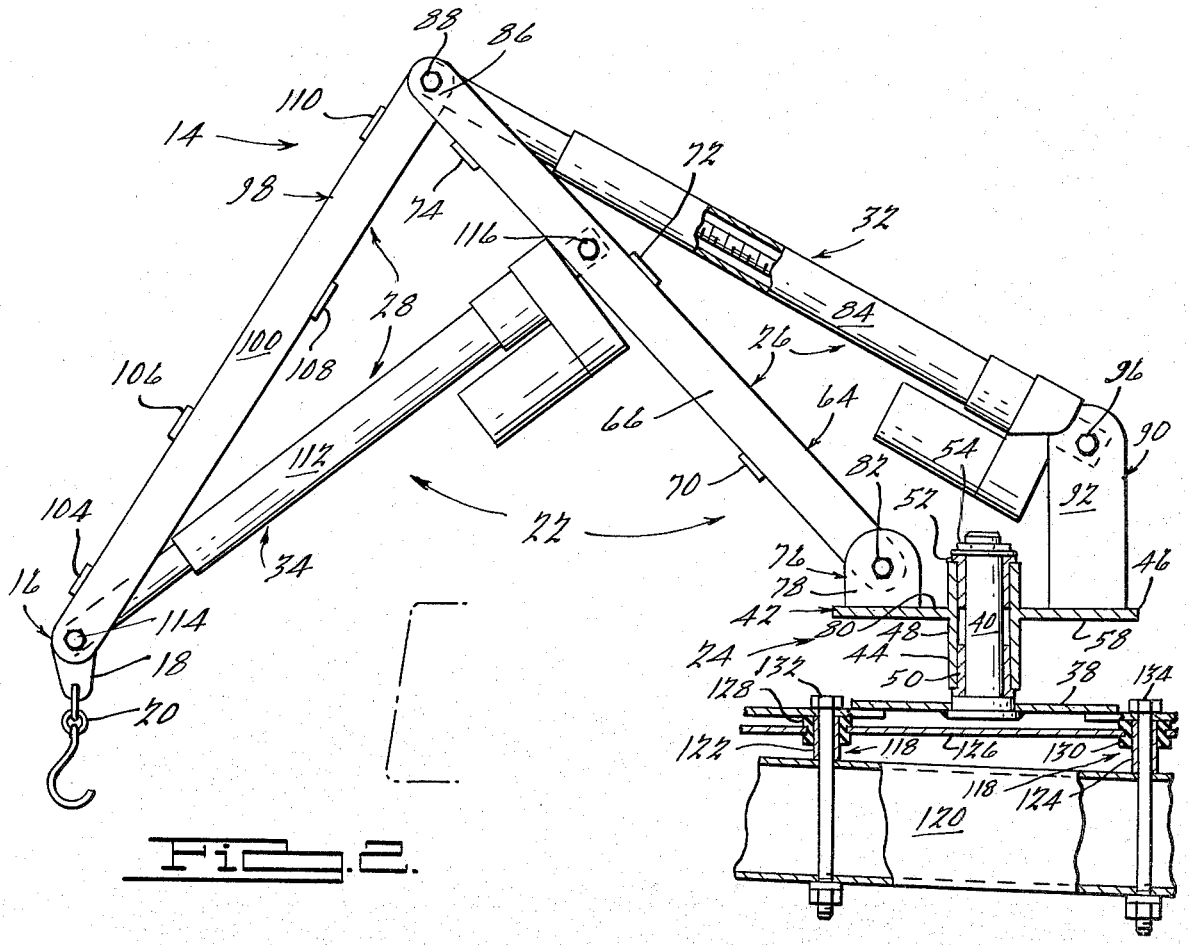
FIG. 2 is a side elevational view, with portions broken away, of the lifting device embodying the invention and showing its attachment to the vehicle chassis.

In order to facilitate the lifting of heavy objects, the device 14 is provided with mounting means, indicated generally at 118, for mounting the device 14 directly to the chassis 120 of the automobile 10 for direct support thereby. The chassis 120 may be the frame of the automobile 10. In the alternative, the chassis 120 may be a structural member of a unitized automobile body. Mounting means 118 may comprise three or more elongated hollow cylindrical metal spacer elements, two of which are shown in FIG. 2 at 122 and 124. Since all of the spacer elements are similar in construction, only the two illustrated will be discussed hereinafter. Spacer elements 122 and 124 are designed to pass through suitably sized holes in the sheet metal body 126 of automobile 10. Spacer elements 122 and 124 are provided with rubber or other type grommets 128 and 130 designed to provide a water and dust tight seal around spacer elements 122 and 124. Each spacer element is of such a length as to extend through body 126 to chassis 120 and be supported thereby such that any load placed upon the element will be transmitted to the chassis 120. Such a mounting means enables the chassis 120 to provide direct support for the device 14 and allows for the lifting and loading of objects heavier than otherwise possible by the device 14.

To mount the device 14 by way of mounting means 118, suitably placed and sized holes may be placed in plate assembly 38 of rotational means 24 and chassis 120, and suitable bolt-nut combinations 132 and 134 utilized in conjunction with spacer elements 122 and 124 to secure the device 14 directly to the chassis 120 through the body 126 of the automobile 10.

In addition to being adapted to be mounted directly to the chassis 120, the utility of the device 14 is enhanced by its relatively compact size. This enables the device 14 to be retained within storage space 12 at all times and to be folded through appropriate actuation of the respective moving means 26 and 28 for rotational means 24 so as to be capable of being totally contained within the storage space 12 when not in use. This feature enables the device 14 to assist in the lifting and loading of objects from a first point of use into the storage space 12 of the automobile 10, be transported within the storage space 12 along with such objects by the automobile 10 from the first point of use to a second point of use, and assist in the lifting and unloading of such objects from the storage space 12 to the second point of use. In effect, the device 14 becomes a novel and useful feature of the storage space 12 of the automobile 10 thereby enhancing the utility of the storage space 12 for disabled or handicapped individuals. Without such a storage space-device combination, the storage space 12 of the automobile 10 might not be as accessible and useful to such individuals desiring to transport objects from one place to another with the automobile 10. With the combination, the storage space 12 can be more easily utilized for such tasks, allowing such individuals a more gratifying, less encumbered life which is less dependent on others.

While it will be apparent that the preferred embodiment of the invention herein disclosed is well calculated to achieve the advantages and features as hereinabove set forth, it will be appreciated that the invention is susceptible to modification, variation and change without departing from the spirit and scope thereof, as defined by the appended claims.

What is claimed is:

1. A device for assisting a disabled person in the lifting and loading of objects between a trunk of an automobile and a point of use wherein the trunk is defined in part by a sheet metal floor, and which automobile has a chassis member in part underlying and spaced below the sheet metal floor, said device including a mounting plate assembly adapted to be positioned in the trunk above the sheet metal floor and juxtaposed to the underlying chassis member, means for directly affixing said mounting plate assembly to the underlying chassis member comprising substantially rigid spacer members adapted to extend through the sheet metal floor of the trunk and between said plate assembly and the underlying chassis member for vertically supporting said mounting plate assembly upon the underlying chassis member, bolt means extending from the upper side of said plate assembly through said spacer members and adapted to be engaged with the underlying chassis member for retaining said spacer members in supporting relationship between said mounting plate assembly and the underlying chassis member, said mounting plate assembly having affixed thereto an upstanding shaft extending upwardly and within the trunk, a turntable journaled upon said shaft, first power means interposed between said turntable and said mounting plate assembly for rotating said turntable about said shaft, an object engaging member, a supporting member for supporting said object engaging member for movement relative to said turntable, second power means operatively interconnected between said turntable and said supporting member for moving said object engaging member in a generally vertical direction relative to said turntable, and third power means operatively connected between said turntable and said supporting member for moving said object engaging member in a generally horizontal direction, said first, second and third power means being capable, when actuated, of moving said object engaging member into a storage position within the trunk wherein the suppporting member is totally confined within the trunk and for moving said object engaging member to an extended position wherein an object may be moved between the trunk and a location outside of the automobile.

* * * * *